US007384245B2

(12) United States Patent
Hernandez et al.

(10) Patent No.: US 7,384,245 B2
(45) Date of Patent: Jun. 10, 2008

(54) COMPRESSOR WITH ROTATING HANDLE

(75) Inventors: Hector R. Hernandez, Fullerton, CA (US); Jaime W. Nash, Rancho Santa Margarita, CA (US)

(73) Assignee: Alltrade Tools LLC, Long Beach, CA (US)

( * ) Notice: Subject to any disclaimer, the term of this patent is extended or adjusted under 35 U.S.C. 154(b) by 505 days.

(21) Appl. No.: 10/978,337

(22) Filed: Nov. 1, 2004

(65) Prior Publication Data

US 2006/0093489 A1 May 4, 2006

(51) Int. Cl.
*F04B 53/00* (2006.01)
*F04B 23/00* (2006.01)
*F04B 39/00* (2006.01)

(52) U.S. Cl. ..... 417/234; 417/313; 417/321; 417/572

(58) Field of Classification Search ..... 417/234, 417/313, 321, 572
See application file for complete search history.

(56) References Cited

U.S. PATENT DOCUMENTS 2,804,259 A * 8/1957 Ralston ..... 137/899.4
6,164,493 A * 12/2000 Shelton, Jr. ..... 222/1
D440,578 S 4/2001 Nolan
D444,796 S 7/2001 Morgan
D454,357 S 3/2002 Diels
6,375,437 B1 * 4/2002 Nolan ..... 417/234
D485,508 S 1/2004 Hacmon
D485,782 S 1/2004 Hacmon
D499,431 S 12/2004 Chen
D500,050 S 12/2004 Lucchi
D500,052 S 12/2004 Lucchi
D500,328 S 12/2004 Lucchi
D505,430 S 5/2005 Buck
D513,619 S 1/2006 Hernandez et al.
D531,193 S 10/2006 Caito
D537,839 S 3/2007 Bruno et al.
D541,305 S 4/2007 Hernandez et al.
2003/0129065 A1 * 7/2003 Hu ..... 417/234
2003/0180156 A1 * 9/2003 Brashears et al. ..... 417/234

* cited by examiner

*Primary Examiner*—Devon C. Kramer
*Assistant Examiner*—Patrick Hamo
(74) *Attorney, Agent, or Firm*—Steptoe & Johnson LLP

(57) ABSTRACT

An air compressor assembly including a rotatable handle that provides protection and structure for transporting the apparatus. The apparatus further includes a plurality of air tanks each of which are configured to be removable and replaced when necessary.

13 Claims, 3 Drawing Sheets

COMPRESSOR WITH ROTATING HANDLE

BACKGROUND OF THE INVENTION

The present invention relates to an air compressor assembly, and more particularly to an assembly including replaceable tanks and a rotating handle sub-assembly.

Air compressors have been adapted for use in various applications. Generally, air compressors provide pneumatic power which can be employed to create projecting, rotational or other forces. As such, air compressors have conventionally been used as a source of power in assembling or disassembling items or machines. Air compressors have also been utilized as a driving force in devices such as nail guns. Many other applications benefit from the power generating by air compressors.

Typically, air compressor assemblies include a motor for driving a compressor and a tank for storing compressed air. When air is compressed, there is associated therewith some level or degree of condensation within the tank storing the compressed air. Although some efforts have been made to select materials which resist corrosion and to provide valves for removing moisture, the condensation within a storage tank eventually causes corrosion. Such corrosion limits the useful life of the compressor.

As in most conventional air compressor assemblies, the air storage tanks are welded to the motor or otherwise form a non-removable structure. In conventional air compressor assemblies which include a plurality of storage tanks, such tanks are often welded or otherwise affixed to each other. Therefore, since it is critical to safety concerns that the structure of storage tanks not be compromised, once a storage tank has exhibited some degree of deterioration, the entire air compressor assembly becomes obsolete and must be discarded. Repair of the compressor assembly is often cost prohibitive or unwieldy.

Air compressor assemblies are often used in situations or environments which subject the assembly to a high degree of wear and tear. For example, objects such as tools can fall on the compressor assembly or transportation of the compressor assembly about a worksite invariably results in collisions with other structures. While compressor assemblies have been made to be portable, little attention has been given to protecting the apparatus from impact. This is particularly true with respect to valve stems and gauges of a compressor assembly.

Accordingly, what is needed and not previously provided is a compressor assembly that permits the replacement of storage tanks as well as provides structure for protecting the apparatus and aiding in its transportation. The present invention satisfies these and other needs.

SUMMARY OF THE INVENTION

Briefly and in general terms, the present invention is directed towards an air compressor assembly including removable parts and structure intended to protect the apparatus. In one aspect, the air compressor assembly is portable and includes a plurality of storage tanks.

In one embodiment, the air compressor assembly includes a frame housing having a motor assembly for driving a compressor. Also, contained within the frame is one or more tanks for storing compressed air. A driver assembly connects the motor assembly with the compressor and a supply line as provided to transport compressed air from the compressor to the storage tank.

In one particular embodiment, the air compressor assembly includes a pair of air storage tanks which are individually mounted within a frame assembly. Each of the storage tanks can be removable from the frame assembly and can be replaced once signs of deterioration are identified.

In another particular embodiment, the frame assembly includes a rotating handle sub-assembly. In a closed position, the handle assembly acts to protect the air compressor apparatus. In an open configuration, the handle assembly can be employed to facilitate transportation of the air compressor assembly. In that regard, the air compressor assembly is provided with a pair of wheels upon which the apparatus can be transported.

Other features and advantage of the present invention will become apparent from the following detailed description, take in conjunction with the accompanying drawings, which will illustrate, by way of example, the principles of the invention.

DETAILED DESCRIPTION OF THE INVENTION

Figure 1:
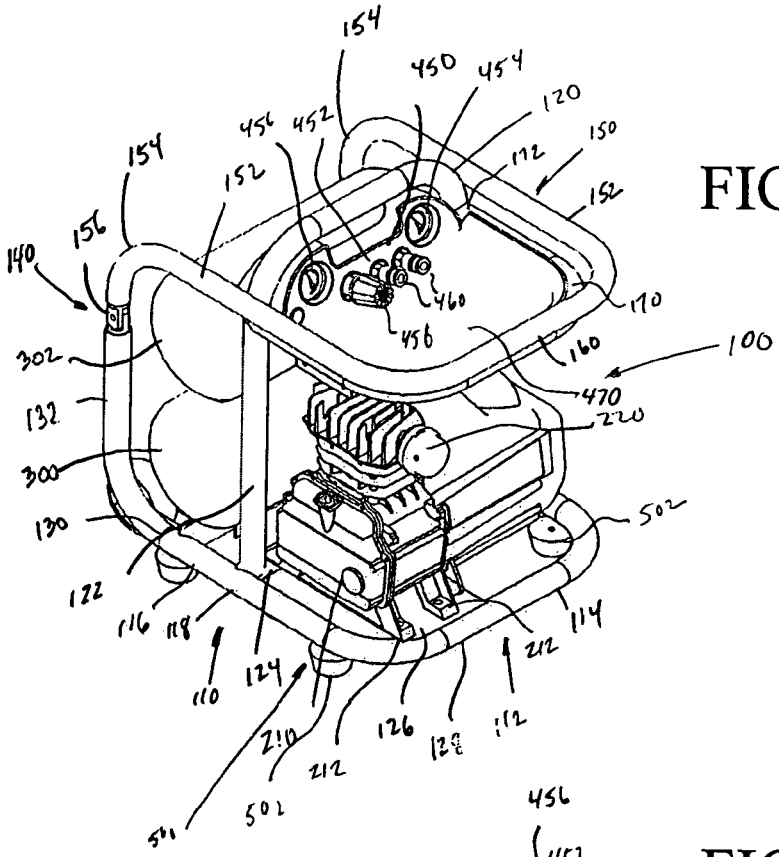
FIG. 1 is a perspective view, depicting an air compressor assembly of the present invention with a handle assembly in a closed position.
Figure 2:
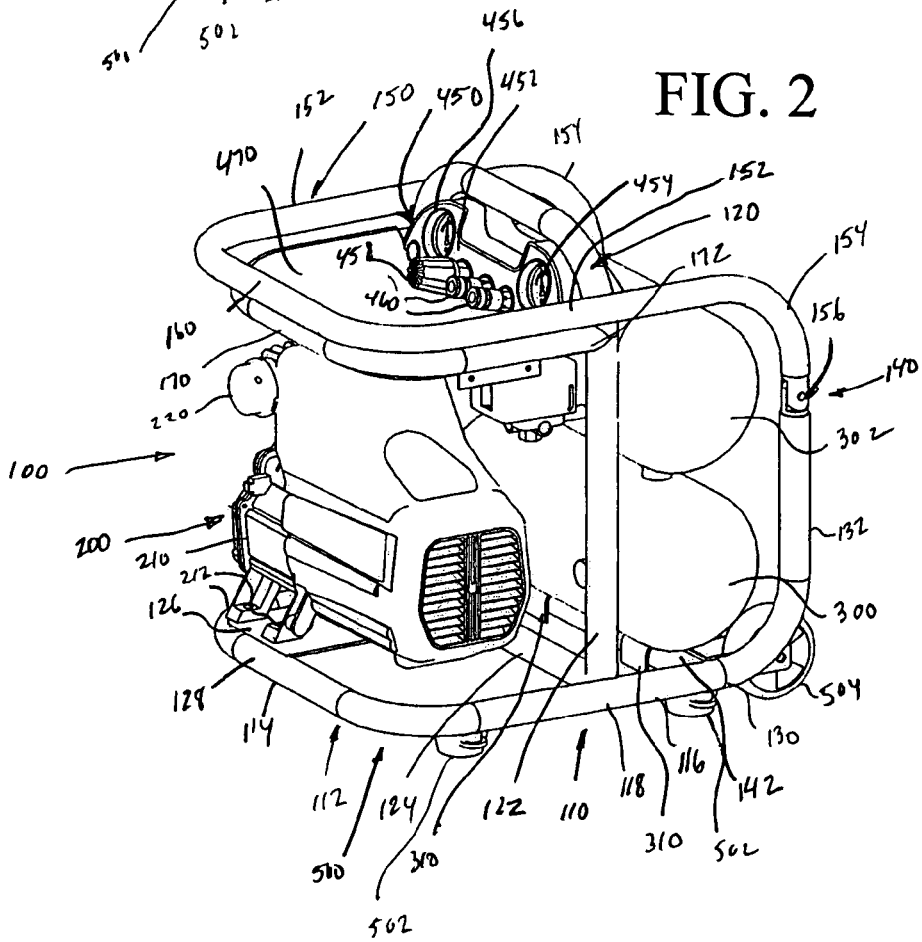
FIG. 2 is a perspective view, depicting the air compressor assembly of FIG. 1 turned approximately 90° clockwise.

Referring now to the drawings, which are provided by way of example and not limitation, the present invention is embodied in an air compressor assembly which includes structure not contemplated in prior compressors. In particular, the air compressor assembly of the present invention provides protective structure which also facilitates transportation. The air compressor assembly additionally includes structure which provides the apparatus with means for enhancing the useful life thereof.

With reference to FIGS. 1-4, there is shown an air compressor assembly 100. The air compressor assembly 100 includes a frame assembly 110 which houses and contains various sub-assemblies of the air compressor apparatus 100. The frame assembly 110 can be manufactured from 1¼ inch tubing which is bent to a desired shape. Multiple sections of such tubing are welded together to form the frame assembly 110.

In one embodiment, the frame assembly 110 includes a base or bottom portion 112 defined by a first U-shaped member 114. The first U-shaped member 114 includes a pair of spaced, generally parallel arms 116 each of which have a mid-section portion 118. Arranged generally perpendicularly to the first U-shaped member is a second generally U-shaped structure 120, which also includes a pair of spaced, generally parallel arms 122. When in an assembled form, each arm 122 of the second U-shaped structure 120 projects vertically from the mid-section 118 of a single arm 116 of the first generally U-shaped member 114. Also attached across arms 116 of the first U-shaped member 114 and affixed to lower terminal ends of arms 122 of the second U-shaped structure 120 is a horizontally extending component 124. Further, a horizontally extending plate 126 is attached at one end to the horizontally extending component 124 and at another end to a front portion 128 of the first U-shaped member 114 of the base 112.

Affixed to terminal ends 130 of each of arms 116 of the first U-shaped member 114 is a vertical component 132 which themselves terminate with a hinge and stay assembly 140. Also connected to the terminal ends 130 of the U-shaped base 112 is a second horizontally extending member 142.

The frame assembly 112 also includes an U-shaped tubular handle assembly 150 that includes a pair of spaced arms 152 which each have a curved portion 154 and terminal ends 156. Terminal ends 156 are configured to mate with and embody a portion of the hinge assemblies 140. The handle 150 can also be equipped with a grip (not shown) made from an elastomeric material and which is configured across a base portion 160 of the U-shaped sub-assembly.

Another generally U-shaped tubular member 170 is attached at its terminal ends 172 to the second generally U-shaped structure 120 which extends vertically from the base 112. In one aspect, this generally U-shaped tubular structure is configured in a parallel relationship with the base 112.

When assembled, the frame assembly 110 defines a number of compartments. Attached to plate 126 and configured near the base 112 of the frame assembly 110 and beneath the U-shaped tubular member 170 and configured parallel to the base 112 is a motor and compressor assembly 200. A motor assembly 210 includes four spaced feet or attaching structure 212 each of which are affixed to the plate 126 attached to the base 112. Configured atop the motor assembly 210 is a compressor assembly 220.

The frame assembly also defines a compartment for a plurality of compressed air tanks 300, 302. This compartment is located adjacent of the space provided for the motor and compressor assembly 200. A first air tank 300 is releasably mounted to the second horizontal member 142 by a pair of spaced clips or equivalent structure 310. A second air tank 302 is releasably mounted above the first air tank 300 by conventional means. One or more supply tubes (not shown) extend from the compressor to one or both of the air tubes 300, 302, respectively.

Configured and attached within and between the second generally U-shaped structure 120 and horizontal U-shaped member 170 is a control panel and valve assembly 450. The assembly includes a panel 452 which houses a pair of gauges 454, 456 as well as a control knob 458 and a pair of valves 460. In one aspect, the gauges can provide information concerning tank pressure and outlet pressure. Additional gauges can be included to provide information concerning each air tank individually as well as outlet pressure from each tank individually. The control knob 458 controls the outflow of air from the tanks 300, 302. The valves provide an outlet from the tanks 300, 302 and are configured to receive a conventional hose for various devices such as a nail gun. A tray 470 for holding or receiving tools and other work pieces is also provided in the space.

Figure 4:
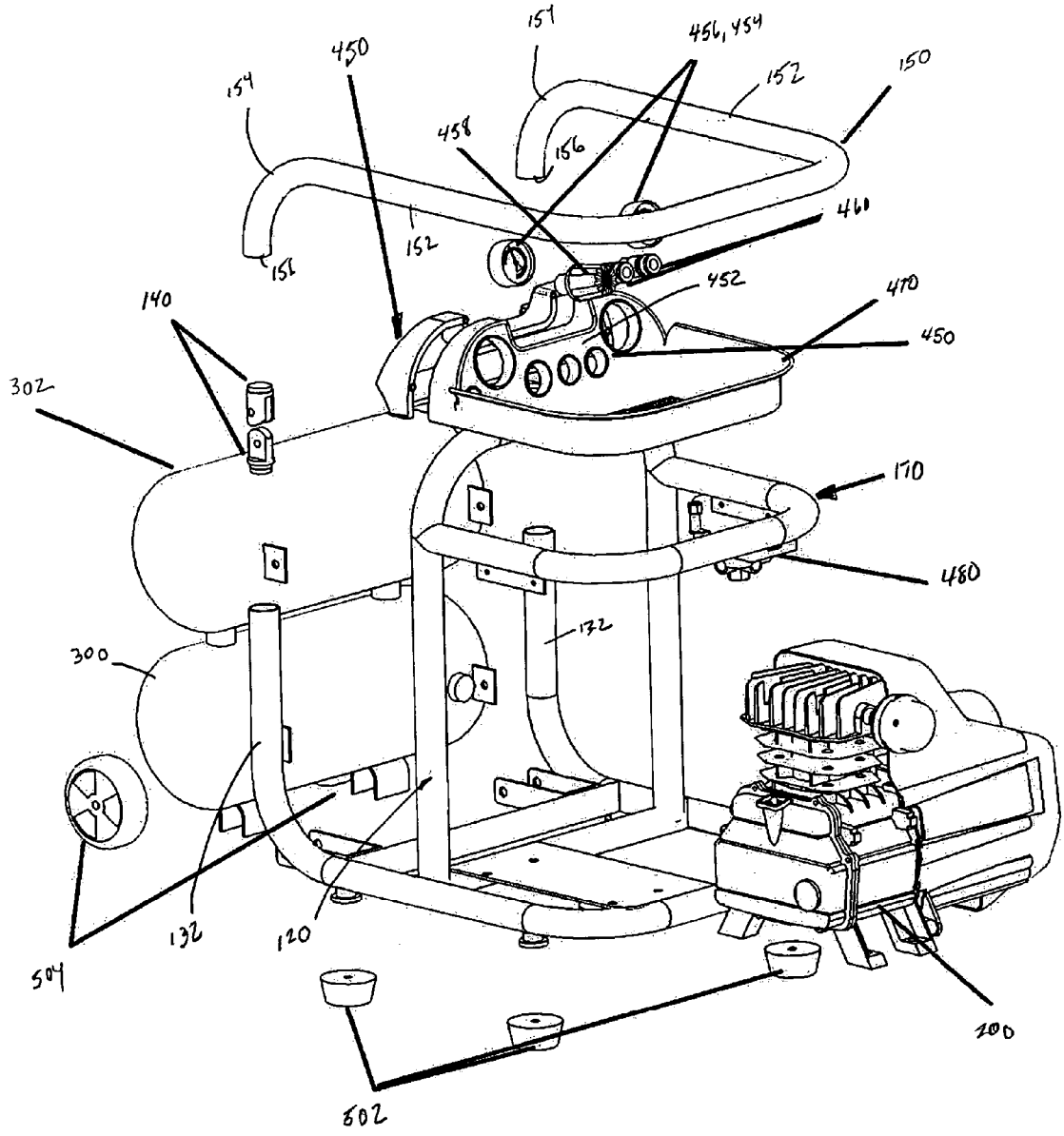
FIG. 4 is an exploded view, depicting various components of the air compressor assembly of FIG. 1 in a disassembled form.

Also attached to the frame assembly 170 is a pressure ON/OFF switch 480 (See FIG. 4). The power switch 480 is in electronic communication with the motor and compressor assembly 200. Turning the power switch to an on position starts the motor and compressor assembly 200 so that air is withdrawn into the assembly and then compressed and delivered to the air tanks 300, 302. Turning the switch to an OFF position ceases this action.

Extending from one or both of the air tanks 300, 302 is an outlet tube (not shown). It is to be understood that the present invention contemplates both providing air from the compressor 220 to each air tank 300, 302 individually as well as to one air tank which is in communication with a second air tank. The present invention also contemplates a single outlet hose from one of the two tanks which are in communication with each other as well as a pair of separate outlet hoses, one for each tank.

Attached to a bottom 500 of the frame assembly 110 are two pairs of rubber feet 502. Such rubber feet 502 are contemplated to be affixed to an underside of the arms defining the first U-shaped member 114. Additionally, the present invention contemplates attaching a pair of spaced wheels 504 by conventional structure to vertical components 132 such that the wheels 504 only engage the ground when the air compressor 100 is tilted off of the rubber feet 502.

Figure 3:
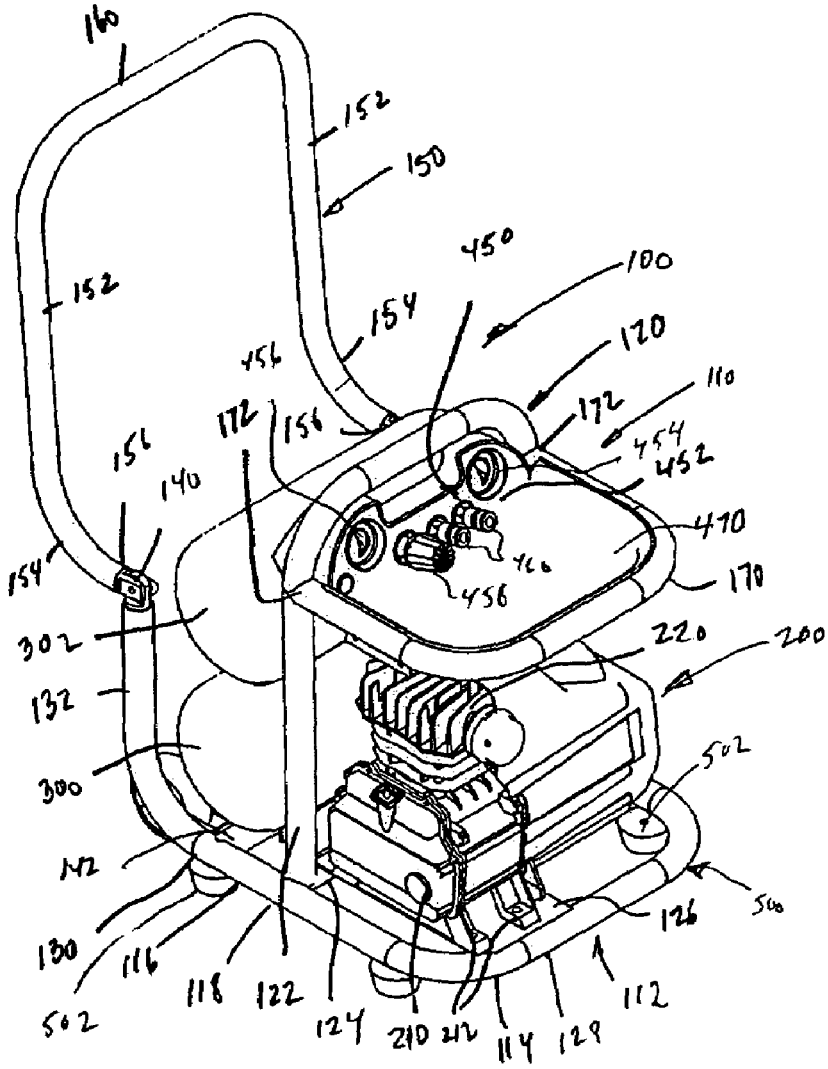
FIG. 3 is perspective view, depicting the air compressor of FIG. 1 with the handle assembly in an open position.

As can be understood from reviewing FIGS. 1 and 3 in conjunction, the rotatable U-shaped handle assembly 150 can assume a first closed position and a second open position. In its closed position, the handle assembly 150 is generally parallel to the floor, the arms 152 of which provide protection to an upper or top side 510 of the air compressor assembly 100. When placed in its opened configuration, the handle assembly 150 can assume a generally vertical position as it is held in place by a stay provided by the hinge assemblies 140. In the vertical position, the handle assembly 150 can be employed to tilt the apparatus upon wheels 504 for transporting the device to and from a worksite or storage area.

Accordingly, the present invention provides an air compressor assembly adapted to address corrosion affecting compressed air tanks. The present invention also embodies structure both protecting the compressor assembly and facilitating its transportation. Moreover, it is contemplated that one or both of the air tanks can be employed to store compressed air and to be accessed either individually or in combination.

Thus, it will be apparent from the foregoing that, while particular forms of the invention have been illustrated and described, various modifications can be made without parting from the spirit and scope of the invention.

We claim:

1. An air compressor assembly, comprising:

a frame assembly, the frame assembly including an air tank storage compartment, a motor and compressor storage compartment, and an air supply and control mounting compartment;

the frame assembly further including a bottom portion defined by a first U-shaped member, the first U-shaped member including a pair of spaced vertical components rotatably attached to which is a U-shaped handle assembly, arranged perpendicularly to the first U-shaped member and spaced from and parallel to the pair of spaced vertical components is a second U-shaped member, arranged perpendicularly to the second U-shaped member is a third U-shaped member which extends horizontally to a first location, configured between the second U-shaped member and third U-shaped member is a tray, wherein the handle assembly rotates between a first open position and a second closed position such that when in the second closed position the handle assembly is horizontal and adjacent the third U-shaped member and extends above and at least to the first location;

a first air storage tank, the first air storage tank being configured within the air tank storage compartment;

a second air storage tank, the second air storage tank being configured within the air tank storage compartment;

a motor configured within the motor and compressor storage compartment; and a compressor configured within the motor and compressor storage compartment.

2. The air compressor assembly of claim 1, wherein the rotatable handle assembly has a closed position and an open position.

3. The air compressor assembly of claim 2, wherein the air compressor assembly includes a top portion and the handle assembly overlays the top portion when in the closed position.

4. The air compressor assembly of claim 2, wherein the frame assembly further includes a stay that engages a handle portion of the handle assembly when the handle assembly is in the open configuration.

5. The air compressor assembly of claim 4, wherein the frame assembly includes a bottom portion and further comprising a pair of wheels mounted to the bottom portion of the frame assembly.

6. The air compressor assembly of claim 5, further comprising a plurality of feet extending from the bottom portion of the frame assembly.

7. The air compressor assembly of claim 1, further comprising a first valve assembly operatively connected to the first air storage tank.

8. The air compressor assembly of claim 7, further comprising a second valve operatively connected to the second air storage tank.

9. The air compressor assembly of claim 8, further comprising a first gauge configured to provide indicia relating to stored air pressure.

10. The air compressor assembly of claim 9, further comprising a second gauge configured to provide indicia relating to outlet air pressure.

11. The air compressor assembly of claim 10, further comprising an air pressure controller knob that controls air emitted from the air compressor assembly.

12. The air compressor assembly of claim 1, wherein the frame assembly includes a top portion.

13. An air compressor assembly, comprising:

a frame assembly manufactured from a tube and including a top portion and a bottom portion including a first U-shaped portion having a horizontal component and including a pair of spaced vertically projecting tubular members, the tube being bent to define an air tank compartment, a motor and compressor compartment and a control panel, the frame assembly including a U-shaped handle assembly formed from a tube, the handle assembly including first and second terminal ends each being rotatably connected to the pair of spaced vertically projecting tubular members of the first U-shaped portion;

the frame assembly further including a second U-shaped portion arranged perpendicularly to the first U-shaped portion and which extends horizontally to a first location, a third U-shaped portion arranged perpendicular to the first U-shaped portion, configured between the second U-shaped portion and third U-shaped portion is a tray;

first and second air tanks arranged in a vertical stack, the first and second air tanks being configured within the air tank compartment;

a motor assembly configured within the motor and compressor compartment;

a compressor assembly cooperating with the motor assembly, the compressor assembly configured within the motor and compressor compartment;

an air supply assembly connecting the compressor assembly to one of the first and second air tanks;

a control panel housing a control knob, first and second valves, and a plurality of gauges;

at least four rubber feet attached to the bottom portion of the frame assembly;

a pair of wheels rotatably attached to the bottom portion of the frame assembly; and a tray configured on the top portion of the frame assembly;

wherein the handle assembly overlaps and protects the tray and control panel and includes a first closed position where the handle assembly is horizontal and adjacent the third U-shaped member and extends above and to a second location beyond the first location and a second open position whereby the handle assembly is placed against a stay and held in a generally vertical position for facilitating tilting the air compressor assembly on the pair of wheels;

wherein the control panel is arranged above the air tank and motor and compressor compartments and the second U-shaped portion has a width less than that of the first U-shaped portion.

* * * * *